United States Patent [19]

Sorum

[11] 3,990,282

[45] Nov. 9, 1976

[54] TUMBLER TYPE LOCK

[76] Inventor: Lorang N. Sorum, 1941 - 42nd Ave., Calgary, Alberta, Canada

[22] Filed: June 24, 1975

[21] Appl. No.: 589,761

[52] U.S. Cl. ..... 70/364; 70/377; 70/419

[51] Int. Cl.[2] ..... E05B 29/04

[58] Field of Search ..... 70/364 R, 364 A, 365, 70/366, 419, 421, DIG. 54, DIG. 55, 377

[56] References Cited

UNITED STATES PATENTS

| | | | |
|---|---|---|---|
| 1,600,661 | 9/1926 | Winning | 70/364 R |
| 2,158,501 | 5/1939 | Gutman | 70/419 |
| 3,287,944 | 11/1966 | Crumb | 70/364 R |
| 3,722,241 | 3/1973 | Sussina | 70/DIG. 54 |

FOREIGN PATENTS OR APPLICATIONS

| | | | |
|---|---|---|---|
| 508,250 | 12/1954 | Canada | 70/364 R |

*Primary Examiner*—Paul R. Gilliam
*Assistant Examiner*—Kenneth J. Dorner
*Attorney, Agent, or Firm*—Stanley G. Ade

[57] ABSTRACT

Conventional tumbler type locks are capable of being breached by lock picking tools, punches, drills and the like. This particular lock includes a plurality of flat strip tumblers mounted transversely in a cylinder and which are positioned relative to one another when a flat key is inserted. The key edges are symmetrically shaped and the edges of different keys are shaped differently so that any number of variations of keys is possible. When the correct key is inserted into the lock, slots cut in the upper sides of the flat tumblers align at which time a knife edge strip clears the aligned slots. When the key and lock are turned, the member engages serrations formed on the upper sides of the tumblers thus locking same into position. The upper side of the member engages an interior cam formed on the casing thus moving the member into engagement of the aforesaid. Another cam moves the knife edge strip into engagement with the slots cut in the tumblers so that the outer edges of both the member and the knife edge strip lie flush with the outer surface of the tumbler block thereby permitting the tumbler to be rotated and the lock actuated. If the wrong key is used, the outer end of the knife edge strip will not move downwardly to lie flush with the outer surface of the cylinder under which circumstances it engages a shoulder formed on the interior of the casing, forcing the spring loaded tongue out of position as the cylinder is partially rotated. This prevents the cylinder from being fully rotated thereby preventing the lock from being actuated.

24 Claims, 13 Drawing Figures

TUMBLER TYPE LOCK

BACKGROUND OF THE INVENTION

This invention relates to new and useful improvements to locks of the cylinder and tumbler type.

Conventional cylinder and tumbler type locks can be breached by conventional mechanical picks, drills, punches and the like. Coagulating substances can be used to lock the tumblers in the disengaged position of conventional locks and under certain circumstances, forceable shearing of the tumblers can cause the lock to be broken. Furthermore, electronic probes and measurements can be made which will allow an intruder to manufacture his own key.

SUMMARY OF THE INVENTION

The present invention overcomes all of these disadvantages by providing a cylinder having a plurality of strip type tumblers mounted therein. A flat key is utilized having shaped edges which can be inserted along one side of the tumblers in slots provided therein. The shaped edges cause the tumblers to move sideways and lie in a given position depending upon the shapes on the edges of the key. When the correct key is used for a particular lock, a plurality of release slots in the tumblers are aligned thus allowing a release member to be engaged therein. As the tumbler is turned, a locking block is depressed and locks the tumblers firmly in position. At the same time the outer end of the release tongue lies flush with the locking block thus allowing the tumbler to be rotated. If the wrong key is used, the outer end of the release tongue does not lie flush and engages a shoulder within the casing of the lock.

The principal object and essence of the invention is therefore to provide a device of the character herewithin described which increases the difficulty of compromising cylindrical tumbler type locks.

Another object of the invention is to provide a deterrent against surreptitious entry of locked premises.

A still further object of the invention is to provide a device of the character herewithin described in which an extremely large number of combinations can be provided at little extra cost thereby decreasing the random factor of accidentally opening the lock by a wrong key.

A still further object of the invention is to provide a device of the character herewithin described which enables a master key to be provided to open any number of doors having this type of lock installed therein.

Still another object of the invention is to provide a device of the character herewithin described which can be utilized in complexes such as apartment buildings where many keys must open one door without substantially decreasing the effectiveness of the one lock.

A still further object of the invention is to provide a device of the character herewithin described which can be used in many environments such as homes, automobiles, offices, boats and trailers and the like thus eliminating the necessity of carrying an individual key for each lock.

Still another object of the invention is to provide a device of the character herewithin described which provides a reversible key which will enter the lock either way.

Finally, a further object of the invention is to provide a device of the character herewithin described which enables a strong and resistant lock to be provided at relatively low manufacturing cost. Furthermore the invention is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
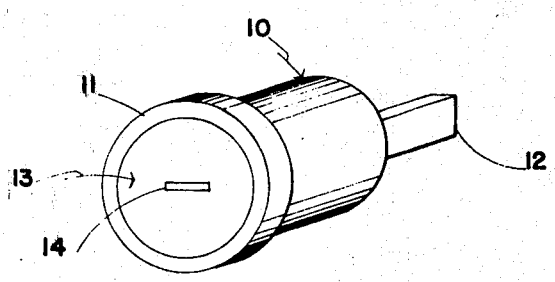
FIG. 1 is an isometric view of the lock assembly per se shown in reduced scale with reference to the remainder of the views.

Proceeding therefore to describe the invention in detail, reference should first be made to FIG. 1 which shows a substantially cylindrical casing 10 having a front flange 11 thereon and a conventional lock bolt engaging member 12 extending rearwardly therefrom.

This lock assembly may be engaged within a door or the like by conventional means (not illustrated) and as these do not form part of this invention, it is not believed necessary to describe same further.

Within the front flange 11 and rotatable within the casing 10 is a lock cylinder or tumbler housing collectively designated 13 having a substantially flat rectangular key slot 14 formed therein.

Figure 2:
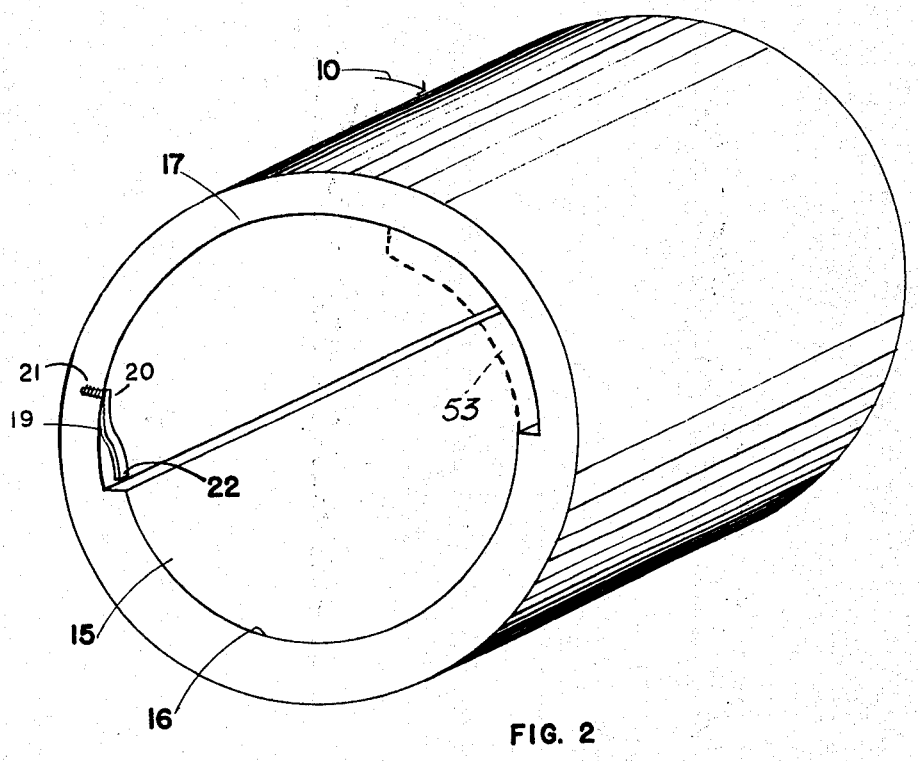
FIG. 2 is an isometric view of the cylindrical casing per se.

The casing 10 is depicted in FIG. 2 but without the front flange 11. This casing is provided with a central bore 15 within which the lock cylinder 13 is mounted for rotation therein. It will be observed that the bottom portion 16 of the casing is provided with a curvature similar to the curvature of the lock cylinder 13 and that the upper portion 17 is provided with a curvature greater than the curvature of the lock cylinder 13, the two curvatures joining by inwardly extending shoulders or ledges 18 which are situated substantially diametrically opposite to one another, the purpose of which will hereinafter be described.

Leaf springs 19 are secured by the upper ends 20 to the inner surface of the upper portion 17 of the casing as indicated at 21 and extend downwardly with reference to the drawings so that the lower ends 22 of the springs engage against the outer surface of the lock cylinder 13 adjacent the shoulders 18.

Figure 5:
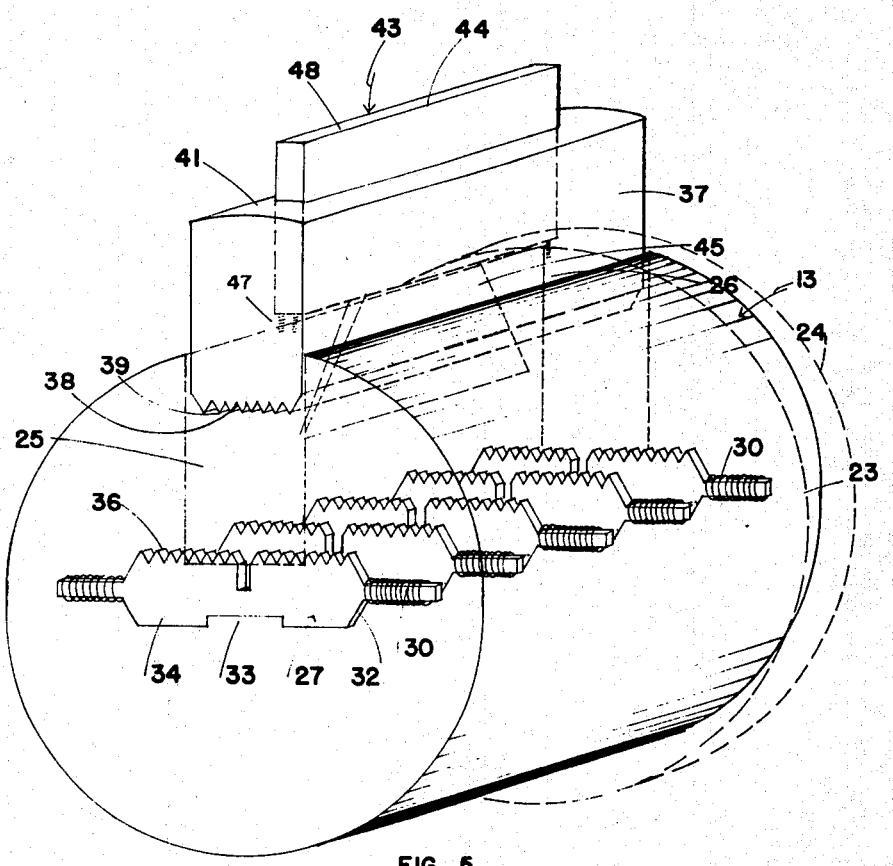
FIG. 5 is a partially exploded isometric view of the lock cylinder assembly with certain parts shown in phantom for clarity.
Figure 4:
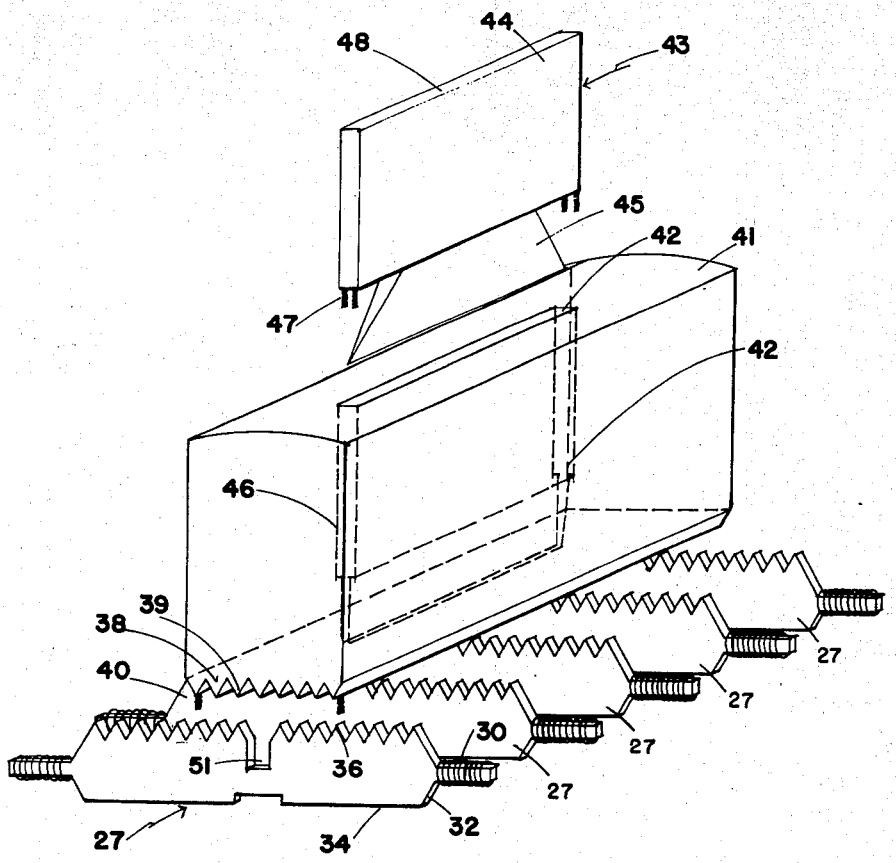
FIG. 4 is an isometric exploded view of the parts of the assembly normally mounted within the lock cylinder.
Figure 6:
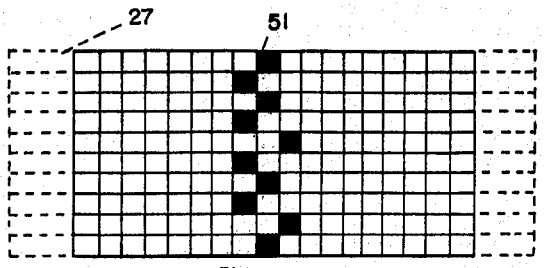
FIG. 6 is a top view of the tumblers in the normal locked position.

The lock cylinder collectively designated 13 is shown in detail in FIGS. 4 and 5. It consists of a cylindrical member 23 having a transverse, substantially rectangular aperture 24 formed therethrough. However, the rear side may be closed by a plate 24 secured to the cylinder and to which the operating shaft 12 of the lock may be secured.

A further rectangular opening 25 is formed in the cylinder and extends from the outer surface 26 downwardly to intersect the aforementioned rectangular slot 24.

A plurality of tumblers collectively designated 27 are situated within the slots 24 and each of these tumblers is a substantially rectangular strip when viewed in front elevation mounted within the slots 24 for sideways movement. Each tumbler is provided with a pin 28 upon either end thereof engageable within a drilling 29 formed through the wall of the cylinder into the slot 24 and springs 30 extend around these pins and react between the sides 31 of the slot and the ends 32 of the tumblers thus normally maintaining the tumblers centrally within the slot 24.

A plurality of tumblers is shown and these tumblers are in interfacial relationship one with the other as clearly illustrated schematically in FIGS. 6, 7, 9 and 10.

Each of the tumblers is provided with a centrally located key receiving slot 33 formed in the lower side 34 thereof and these slots are substantially rectangular when viewed in front elevation. Due to the central alignment of the individual tumblers by means of the spring 30, all of these key receiving slots are aligned when the tumblers are in the position illustrated in FIGS. 3, 6 and 9.

The upper sides 35 of the tumblers are provided with serrations or saw teeth 36, the purpose of which will hereinafter be described.

A tumbler locking block 37 is mounted within the slot 25 in the cylinder 23 and can move vertically therein and the underside or lower edge 38 of this locking block 37 is provided with serrations 39 similar to the serrations 36 hereinbefore described.

Small spring loaded pins 40 extend below the lower side 38 and normally maintain tumbler locking block 37 in the uppermost position shown in FIG. 3 with the upper curved surface 41 engaging the inner curved surface 17 of the casing.

Figure 3:
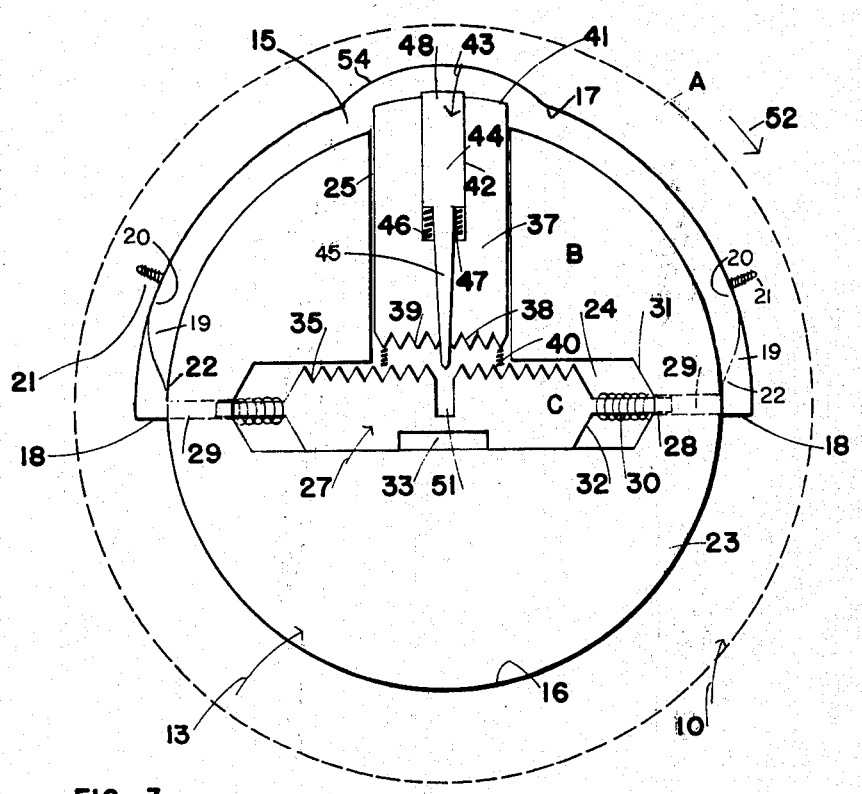
FIG. 3 is an end view of the lock assembly with one end removed to show the interior thereof and showing the lock in the normal locked position.

A substantially rectangular cross sectioned slot 42 is formed through the tumbler locking block 37 as clearly shown in FIG. 3, and a releasing tongue collectively designated 43 is journalled for vertical movement therein.

This releasing tongue includes the mounting portion 44 which engages the sides of the slot 42 and a knife edged strip 45 formed on and extending below the lower side of this mounting portion 44.

The slot 42 is provided with shoulders 46 intermediate the upper and lower ends thereof and small compression springs 47 are secured to the underside of the mounting portion 44 and rest on these shoulders 46 thus normally maintaining the upper edge 48 of the mounting portion 43, in contact with the aforementioned curved surface 17 of the casing.

When assembled, the lock cylinder 13 takes up the position shown in FIG. 3, it being understood that the device is in the normal or locked position under these circumstances.

Figure 11:
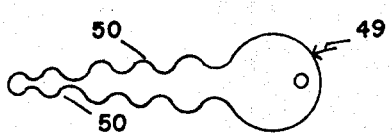
FIG. 11 is a plan view of one embodiment of the keys, it being understood that other shapes can be used.

Reference should next be made to FIG. 11 which shows a key collectively designated 49 utilized with the present lock.

It is a flat strip key having shaped edges 50 both of which are formed symmetrically and these shaped edges may be varied so that each key is different from any other key. It will be appreciated, of course, that many such shapes can can be provided and that no difficulty will be encountered in producing a multiplicity of different shaped keys.

Figure 10:
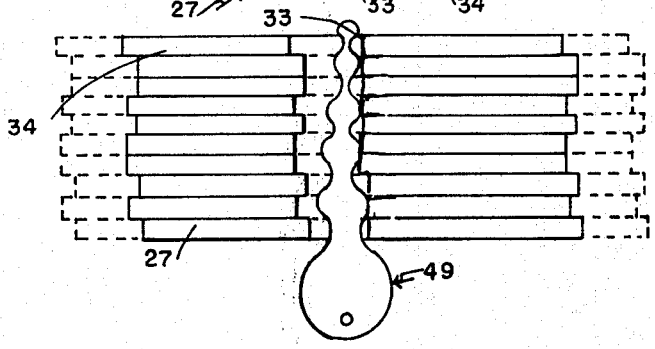
FIG. 10 is a bottom plan view of FIG. 7.

This key is insertable within the rectangular key slot 33 and as it is pushed inwardly, the shaped sides 50 of the key end shift the individual tumblers to one side or the other so that when the key is fully inserted as shown in FIG. 10, the tumblers, for example, may take up the position illustrated in full line in FIG. 10.

Figure 7:
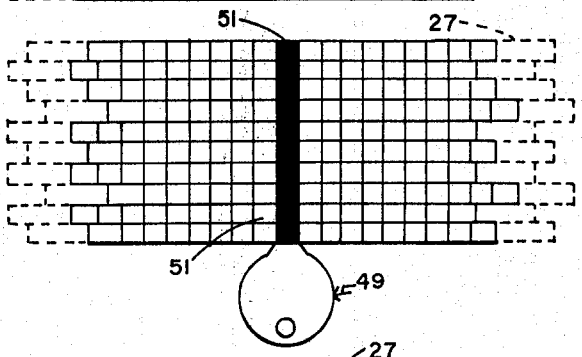
FIG. 7 is a view similar to FIG. 6 but showing the tumblers with a correct key inserted.
Figure 9:
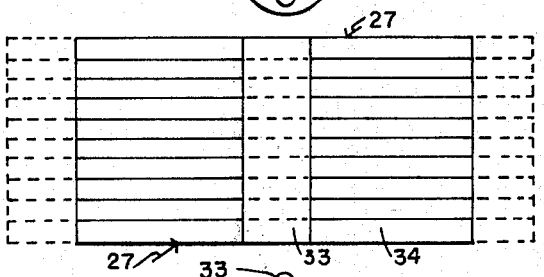
FIG. 9 is a bottom plan view of FIG. 6.

At this point, a release slot 51 is cut across all of the tumblers on the upper side 35 thereof, said slot being shown in full in FIG. 7. stabilizers When the key 49 is then withdrawn, the springs 30 center all of the tumblers back to the original position so that they take up the position shown in FIG. 9. However, reference to FIG. 6, will show that the individual release slots 51 are now completely misaligned, said release slots being shown in solid form in this schematic view for clarity.

When the key 49 is inserted again, the individual slots 51 will align as shown in FIG. 7 and reference should now be made to FIG. 3.

With the key fully inserted, the cylinder assembly 13 can now be rotated in either direction and, for the purposes of this explanation, it is assumed that it is rotated clockwise, namely in the direction of arrow 52.

As soon as the outer surface 41 of the locking block 37 engages the upper end of the leaf springs 19 it will be depressed against the pressure of the relatively light springs 40 thus engaging the serrations 39 at the lower or inner end of this member with the serrations 36 of the individual tumblers and these serrations should be fine enough so that no interference is encountered during this operation. This firmly locks the individual tumblers so that no interference is encountered during this operation. This firmly locks the individual tumblers so that no interference is possible and it, of course, will be appreciated that this action takes place even if a wrong key or a flat strip is used to rotate the cylinder in either direction.

Further rotation of the cylinder assembly in the direction of arrow 52, will cause the leaf springs 19 to force the outer end 48 of the release tongue inwardly against pressure of the relatively light springs 47 and with the release slots 51 fully aligned as shown in FIG. 7, the lower or knife plate 45 will engage within the release slots 51.

As the rotation of the cylinder assembly 13 approaches an angle with reference to FIG. 3, the pressure of the leaf springs 19 will cause the tongue to maintain the relative position shown in FIG. 3 thus allowing the cylinder assembly to be rotated past the shoulder 18.

However, if the wrong key or a flat strip is utilized to turn the cylinder assembly, the locking member 37 will lock into position upon the individual tumblers but the knife edge 45 will be prevented from entering the release slots 51 which, of course, will not all be aligned. This means that the upper end of tongue 48 will remain extended above the upper edge 41 of the locking block and will depress the leaf springs 19 outwardly so that this extending portion of the tongue will strike the shoulder 18 thus effectively preventing any further rotation of the cylinder so that the lock cannot be unlocked.

Figure 12:
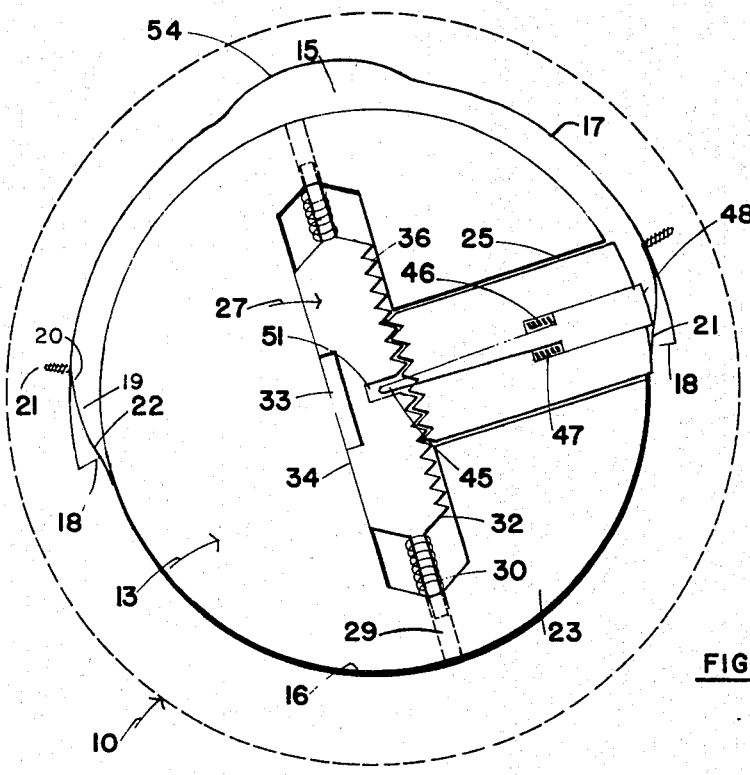
FIG. 12 is a view similar to FIG. 3 but showing the lock in the opening position with the correct key having been inserted.
Figure 13:
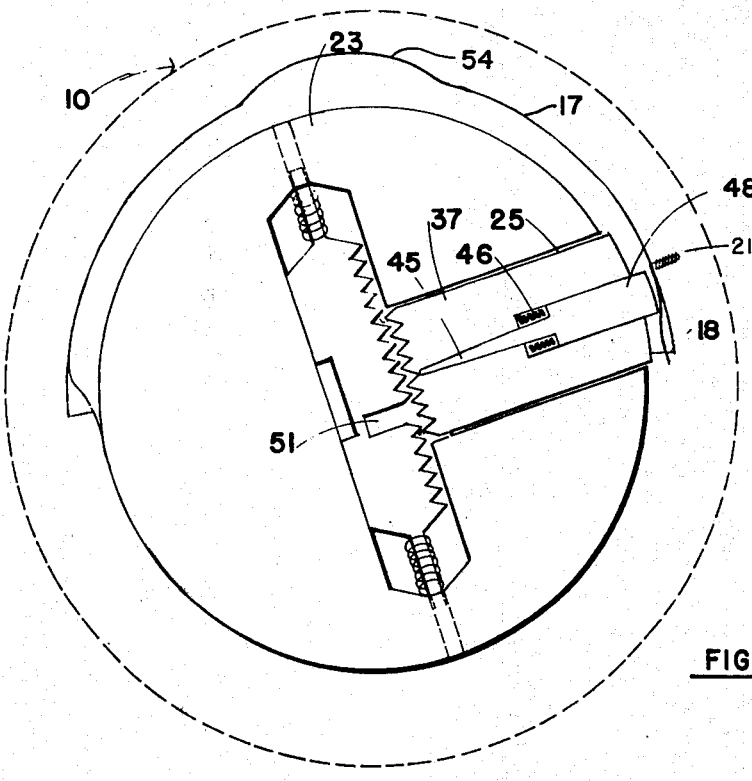
FIG. 13 is a view similar to FIG. 11 but showing the device prevented from opening due to a wrong key or no key having been inserted.

FIG. 12 shows the action of the lock assembly as it approaches the unlocking position with the release slots 51 correctly aligned whereas FIG. 13 shows the action at this point when at least one of the release slots 51 is misaligned. This prevents the knife edge from moving inwardly any further than is shown so that the extending portion strikes the shoulder 18 as hereinbefore described.

From the foregoing it will be appreciated that the individual key may be inserted into the lock whereupon the release slots 51 are cut or milled or punched or knocked out or otherwise formed.

At the same time as the lock is being manufactured, a master key may be inserted and a further set of release slots 51 may be milled and although some of these may coincide with the release slots 51 from the individual key, nevertheless if the shape of the master key is chosen properly, all of the different locks in one series can be provided with a separate set of release slots which will only align when the master key is utilized, which forms a separate alignment to that of the "father" key.

From the foregoing it will be appreciated that it is relatively simple to produce a greater number of individual locks having different keys with the release slots of each lock being cut or milled to suit the individual key only.

Figure 8:
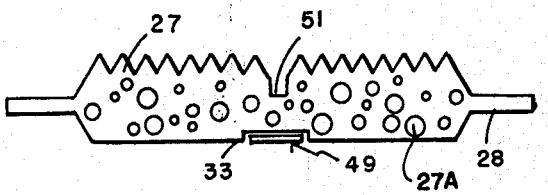
FIG. 8 is a front elevation of one of the tumblers.

Although the tumblers 27 are shown in parallel relationship with one another, nevertheless, they may be mounted at random angular relationship in order to make it more difficult for mills and probes to operate. Also it is desirable that the tumblers 27 be manufactured of relatively hard steel separated by strips of softer steel. This together with the variable angles of the tumblers, will cause a drill to bend or break. If a laser beam is used in an attempt to break the lock, then the soft material will melt and flow thus making the lock inoperative. Also, a plurality of holes or apertures 27A may be formed through the tumblers as shown in FIG. 8 discourages electronic probing of the lock as the holes will give a misleading reading on an electronic scope. Finally, other shapes of tumblers and positions of key slots can be used so that only a small portion of the tumbler is "visible" to the key so that an electronic probe cannot ascertain the exact location of the knife edge slot in the tumbler. It should be noted that FIG. 2 is only one representation of a cylinder wall construction. Using a ledge 53 shown in phantom in FIG. 2, without any springs, the lock becomes operational by counterclockwise rotation only.

Furthermore spring 19 is not a necessity for the engagement of locking block 41 as this can be accomplished by milling a cam (not shown) into the cylinder housing. Spring 19 will then function only in engagement with knife edge 43 as the locking block is depressed by the housing wall directly.

Shoulders 18 may of course be milled in any desired position, depending upon the degree of free play designed into the lock.

It should also be noted that by separating the locking block and knife edge in, for example, an over and under arrangement nothing has been changed to really improve upon the many functions and advantages of the suggested design.

Finally reference is made to a curved recess 54 formed on the inner surface of the casing and engageable by the tumbler locking block 37 and the releasing tongue 43 when the lock cylinder is in the locked position shown in FIG. 3. This enables these two parts to be clear of the tumblers 27 thus enabling the tumblers to be moved when the key is inserted. However as soon as the lock cylinder is turned in either direction, the ends of this recess will force the releasing tongue 43 downwardly into engagement with the tumblers thus freezing the tumbler assembly so that from this point on, the tumblers cannot move individually.

Since various modifications can be made in my invention as hereinabove described, and many apparently widely different embodiments of same made within the spirit and scope of claims without departing from such spirit and scope, it is intended that all matter contained in the accompanying specification shall be interpreted as illustrative only and not in a limiting sense.

What I claim as my invention is:

1. A lock device for use with a key having shaped side edges and comprising in combination a bored mounting casing, an apertured lock cylinder mounted therein for rotation within said casing, a plurality of tumblers transversely mounted within said cylinder for limited sideways movement therein, spring means within said cylinder normally maintaining said tumblers centrally within said aperture, a key receiving slot formed in one side of each of said tumblers, said key receiving slots being substantially aligned when said tumblers are centrally within said cylinder as aforesaid, a tumbler locking block mounted within said cylinder and having an outer surface engageable with the inner surface of said mounting casing, means on said inner surface of said mounting casing to move said locking block into locking engagement with the other sides of said tumblers, means cooperating between said locking block and said other sides of said tumblers to lock said tumblers against sideways movement when said locking block is engaged with said tumblers as aforesaid, a release slot formed in said other surface of each of said tumblers, said release slots aligning when the associated correct key is inserted within said key receiving slots, and means movable within said tumbler locking block and engageable with said release slots when same are aligned.

2. The locking device according to claim 1 which includes means on said inner surface of said casing engageable by said last mentioned means when said release slots are misaligned thereby preventing full rotation of said lock cylinder.

3. The device according to claim 2 in which said means on said inner surface includes an inwardly extending shoulder, leaf springs secured to said casing and normally maintaining contact with the outer surface of said lock cylinder, the outer end of said locking block engaging the surface of said leaf springs when said cylinder is rotated thereby engaging the inner end of said locking block into locking engagement with said other sides of said tumblers, said outer end of said locking block lying flush with the outer surface of said cylinder when in locking engagement with said tumblers.

4. The locking device according to claim 1 in which said last mentioned means includes a releasing tongue movable within said locking block, the lower edge of said releasing tongue engaging said release slots when said release slots are aligned.

5. The locking device according to claim 2 in which said last mentioned means includes a releasing tongue movable within said locking block, the lower edge of said releasing tongue engaging said release slots when said release slots are aligned.

6. The locking device according to claim 3 in which said last mentioned means including a releasing tongue movable within said locking block, the lower edge of said releasing tongue engaging said release slots when said release slots are aligned.

7. The locking device according to claim 6 in which the outer end of said release tongue lies flush with the outer surface of said cylinder when the lower edge of said releasing tongue is engaged within said release slots, said outer end of said releasing tongue extending beyond said outer surface of said cylinder if said lower end of said releasing tongue is disengaged from said release slots due to said release slots being misaligned, whereby said outer end of said releasing tongue engages said shoulder when said cylinder is partially rotated.

8. The locking device according to claim 2 in which said tumblers take the form of elongated substantially rectangular cross section strips situated in substantial interfacial relationship with one another, said means cooperating between said locking block and said other sides of said tumblers including serrations formed on said other sides of said tumblers and mating serrations formed on the inner side of said locking block, said means on said inner surface of said casing engageable by said means movable with said locking block being situated on each side of said casing and substantially diametrically opposite one another thereby preventing rotation of said cylinder in either direction when said release slots are misaligned.

9. The locking device according to claim 3 in which said tumblers take the form of elongated substantially rectangular cross section strips situated in substantial interfacial relationship with one another, said means cooperating between said locking block and said other sides of said tumblers including serrations formed on said other sides of said tumblers and mating serrations formed on the inner side of said locking block, said means on said inner surface of said casing engageable by said means movable with said locking block being situated on each side of said casing and substantially diametrically opposite one another thereby preventing rotation of said cylinder in either direction when said release slots are misaligned.

10. The locking device according to claim 5 in which said tumblers take the form of elongated substantially rectangular cross section strips situated in substantial interfacial relationship with one another, said means cooperating between said locking block and said other sides of said tumblers including serrations formed on the inner side of said locking block, said means on said inner surface of said casing engageable by said means movable with said locking block being situated on each side of said casing and substantially diametrically opposite one another thereby preventing rotation of said cylinder in either direction when said release slots are misaligned.

11. The locking device according to claim 6 in which said tumblers take the form of elongated substantially rectangular cross section strips situated in substantial interfacial relationship with one another, said means cooperating between said locking block and said other sides of said tumblers including serrations formed on said other sides of said tumblers and mating serrations formed on the inner side of said locking block, said means on said inner surface of said casing engageable by said means movable with said locking block being situated on each side of said casing and substantially diametrically opposite one another thereby preventing rotation of said cylinder in either direction when said release slots are misaligned.

12. The locking device according to claim 7 in which said tumblers take the form of elongated substantially rectangular cross section strips situated in substantial interfacial relationship with one another, said means cooperating between said locking block and said other sides of said tumblers including serrations formed on said other sides of said tumblers and mating serrations formed on the inner side of said locking block, said means on said inner surface of said casing engageable by said means movable with said locking block being situated on each side of said casing and substantially diametrically opposite one another thereby preventing rotation of said cylinder in either direction when said release slots are misaligned.

13. The locking device according to claim 1 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

14. The locking device according to claim 2 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

15. The locking device according to claim 3 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

16. The locking device according to claim 4 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

17. The locking device according to claim 5 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

18. The locking device according to claim 6 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

19. The locking device according to claim 7 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

20. The locking device according to claim 8 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

21. The locking device according to claim 9 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

22. The locking device according to claim 10 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

23. The locking device according to claim 11 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

24. The locking device according to claim 12 which includes a substantially planar key having symmetrically shaped side edges, said key being engageable within said key receiving slots, said shaped side edges engaging with the sides of said key receiving slots as said key is inserted thereby individually end shifting said tumblers whereby said release slots are aligned when the correct key is fully inserted.

* * * * *